US011749916B2

(12) United States Patent
Paynter

(10) Patent No.: US 11,749,916 B2
(45) Date of Patent: Sep. 5, 2023

(54) GANGED COAXIAL CONNECTOR ASSEMBLY

(71) Applicant: CommScope Technologies LLC, Hickory, NC (US)

(72) Inventor: Jeffrey D. Paynter, Momence, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/567,407

(22) Filed: Jan. 3, 2022

(65) Prior Publication Data

US 2022/0216624 A1 Jul. 7, 2022

Related U.S. Application Data

(60) Provisional application No. 63/133,888, filed on Jan. 5, 2021.

(51) Int. Cl.

| | |
|---|---|
| ***H01R 9/05*** | (2006.01) |
| ***H01R 13/627*** | (2006.01) |
| ***H01R 103/00*** | (2006.01) |

(52) U.S. Cl.
CPC ..... *H01R 9/05* (2013.01); *H01R 13/6272* (2013.01); *H01R 2103/00* (2013.01)

(58) Field of Classification Search
CPC ..... H01R 13/62933; H01R 13/6272; H01R 9/05; H01R 2103/00

(Continued)

(56) References Cited

U.S. PATENT DOCUMENTS

| | | | | |
|---|---|---|---|---|
| 4,367,003 A | | 1/1983 | Frantz | |
| 4,840,574 A | * | 6/1989 | Mills | H01R 13/66 439/378 |

(Continued)

FOREIGN PATENT DOCUMENTS

KR 100212589 B1 8/1999

OTHER PUBLICATIONS

"International Search Report and Written Opinion corresponding to International Application No. PCT/US2022/011008 dated Apr. 20, 2022".

(Continued)

*Primary Examiner* — Gary F Paumen
(74) *Attorney, Agent, or Firm* — Myers Bigel, P.A.

(57) ABSTRACT

A mated connector assembly includes: a first connector assembly, comprising a plurality of first coaxial connectors mounted on a substrate, each of the first coaxial connectors connected with a respective first coaxial cable, and further comprising a latch pivotally mounted to the substrate, the latch having an arm with a free end; a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors; wherein a slot is present is the shell, the slot providing access to one of the second cavities from outside the shell; wherein in a mated condition each of the first coaxial connectors is mated with a respective second coaxial connector; and wherein the latch is pivotable between an unlatched position, in which the free end of the arm is absent from the slot, and a latched position, in which the free end (Continued)

of the arm of the latch extends through the slot and engages a second coaxial connector; and wherein the first and second connector assemblies are secured in the mated condition by the latch when the latch is in the latched position.

18 Claims, 8 Drawing Sheets

(58) Field of Classification Search
USPC ..... 439/372, 247, 248, 578
See application file for complete search history.

(56) References Cited

U.S. PATENT DOCUMENTS 5,660,558 A 8/1997 Osanai et al.
9,577,377 B1 * 2/2017 Lanzotti ..... H01R 24/40
2005/0181653 A1 8/2005 Shimizu et al.
2018/0337492 A1 * 11/2018 Aoki ..... H01R 13/04
2019/0312394 A1 10/2019 Paynter et al.
2022/0173553 A1 * 6/2022 Paynter ..... H01R 13/6315
2022/0368072 A1 * 11/2022 Paynter ..... H01R 25/003
2022/0368088 A1 * 11/2022 Smentek ..... H01R 24/40

OTHER PUBLICATIONS

"International Preliminary Report on Patentability corresponding to International Application No. PCT/US2022/011008 dated Jul. 20, 2023".

* cited by examiner

GANGED COAXIAL CONNECTOR ASSEMBLY

RELATED APPLICATION

The present application claims the benefit of U.S. Provisional Patent Application No. 63/133,888, filed Jan. 5, 2021, the disclosure of which is hereby incorporated herein by reference in full.

FIELD OF THE INVENTION

The present invention relates generally to electrical cable connectors and, more particularly, to ganged connector assemblies.

BACKGROUND

Coaxial cables are commonly utilized in RF communications systems. Coaxial cable connectors may be applied to terminate coaxial cables, for example, in communication systems requiting a high level of precision and reliability.

Connector interfaces provide a connect/disconnect functionality between a cable terminated with a connector bearing the desired connector interface and a corresponding connector with a mating connector interface mounted on an apparatus or a further cable. Some coaxial connector interfaces utilize a retainer (often provided as a threaded coupling nut) that draws the connector interface pair into secure electro-mechanical engagement as the coupling nut, rotatably retained upon one connector, is threaded upon the other connector.

Alternatively, connection interfaces may be also provided with a blind mate characteristic to enable push-on interconnection, wherein physical access to the connector bodies is restricted and/or the interconnected portions are linked in a manner where precise alignment is difficult or not cost-effective (such as the connection between an antenna and a transceiver that are coupled together via a rail system or the like). To accommodate misalignment, a blind mate connector may be provided with lateral and/or longitudinal spring action, or "float," to accommodate a limited degree of insertion misalignment. Blind mated connectors may be particularly suitable for use in "ganged" connector arrangements, in which multiple connectors (for example, four connectors) are attached to each other and are mated to mating connectors simultaneously.

Examples of ganged coaxial connectors is discussed in U.S. Patent Publication No. 2019/0312394 to Paynter, the disclosure of which is hereby incorporated herein by reference in full. This publication identifies solutions for two different issues that can arise with ganged blind mate connectors: "float" and secure interconnection. Ganged connectors are shown therein with a common shell. Each individual "male" connector is sized to be able to "float" axially, angularly and radially relative to the shell. Also, each individual "male" connector engages a respective helical spring that also engages the shell. Although each connector can move relative to the shell to adjust during mating, compression in the spring can provide sufficient force that, once the male connector is mated, the male connector is maintained in position relative to the shell. The ganged male connectors are secured to the mating "female" connectors via a pivoting latch that captures a pin on gang of male connectors.

It may be desirable to develop additional concepts and solutions for ganged coaxial connectors.

SUMMARY

As a first aspect, embodiments of the invention are directed to a mated connector assembly. The mated connector assembly comprises: a first connector assembly, comprising a plurality of first coaxial connectors mounted on a substrate, each of the first coaxial connectors connected with a respective first coaxial cable, and further comprising a latch pivotally mounted to the substrate, the latch having an arm with a free end; and a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors. A slot is present in the shell, the slot providing access to one of the second cavities from outside the shell. In a mated condition each of the first coaxial connectors is mated with a respective second coaxial connector. The latch is pivotable between an unlatched position, in which the free end of the arm is absent from the slot, and a latched position, in which the free end of the arm of the latch extends through the slot and engages a second coaxial connector. The first and second connector assemblies are secured in the mated condition by the latch when the latch is in the latched position.

As a second aspect, embodiments of the invention are directed to a mated connector assembly comprising: a first connector assembly, comprising a plurality of first coaxial connectors mounted on a substrate, each of the first coaxial connectors connected with a respective first coaxial cable, and further comprising a latch pivotally mounted to the substrate the latch having first and second arms, each with a free end; and a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors. First and second slots are present in the shell, each of the first and second slots providing access to a respective one of the second cavities from outside the shell. In a mated condition each of the first coaxial connectors is mated with a respective second coaxial connector. The latch is pivotable between an unlatched position, in which the free ends of the first and second aims are absent from the first and second slots, and a latched position, in which the free end of the first arm of the latch extends through the first slot and engages a first of the second coaxial connectors, and the free end of the second arm of the latch extends through the second slot and engages a second of the second coaxial connectors. The first and second connector assemblies are secured in the mated condition by the latch when the latch is in the latched position.

As a third aspect, embodiments of the invention are directed to a mated connector assembly comprising: a first connector assembly, comprising a plurality of first coaxial connectors mounted on a substrate, each of the first coaxial connectors connected with a respective first coaxial cable, and further comprising first and second latches pivotally mounted to the substrate, each of the first and second latches having first and second arms, each with a free end; and a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors. First, second, third and fourth slots are present in the shell, each of the first, second, third and fourth slots providing access to a respective one of the second cavities from outside the shell. In a mated condition each of the first coaxial connectors is mated with a respective second coaxial connector. The first latch is pivotable between an unlatched position, in which the free ends of the first and second anus are absent from the first and second slots, and a latched position, in which the free end of the first arm of the latch extends through the first slot and engages a first of the second coaxial connectors, and the free end of the second arm of the latch extends through the second slot and engages a second of the second coaxial connectors. The second latch is pivotable between an unlatched position, in which the free ends of the first and second arms are absent from the third and fourth slots, and a latched position, in which the free end of the first arm of the second latch extends through the third slot and engages a third of the second coaxial connectors, and the free end of the second aim of the second latch extends through the fourth slot and. engages a fourth of the second coaxial connectors. The first and second connector assemblies are secured in the mated condition by the first and second latches when the first and second latches are in the latched position.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

As noted above, an issue that can arise with ganged connector assemblies is the alignment of individual mating connectors. Proper mating of the individual "male" connectors with the individual "female" connectors is needed to ensure that sound electrical contact is made. Quality of electrical contact can become more vital at high performance levels, as poor or inconsistent contact can produce unpredictable passive intermodulation (PIM) performance. PIM is an undesirable effect that can manifest itself in poor connections. As such, it is important in designing mating connectors that the contact/engagement between them be predictable.

A ganged connector assembly can introduce inconsistency in connector mating simply due to variables such as component tolerances. Thus, the ability of the mating connectors in a ganged assembly to float relative to the housing in which they are mounted, and to do so in a manner that maintains reliable and predictable contact between mating connectors, can be very desirable. Float can involve axial (i.e., in the direction of mating), radial (i.e., movement normal to the axial direction), and angular ("tilting" movement relative to the axial direction) components, so any float mechanisms or solution should permit movement in these three modes.

Figure 1:
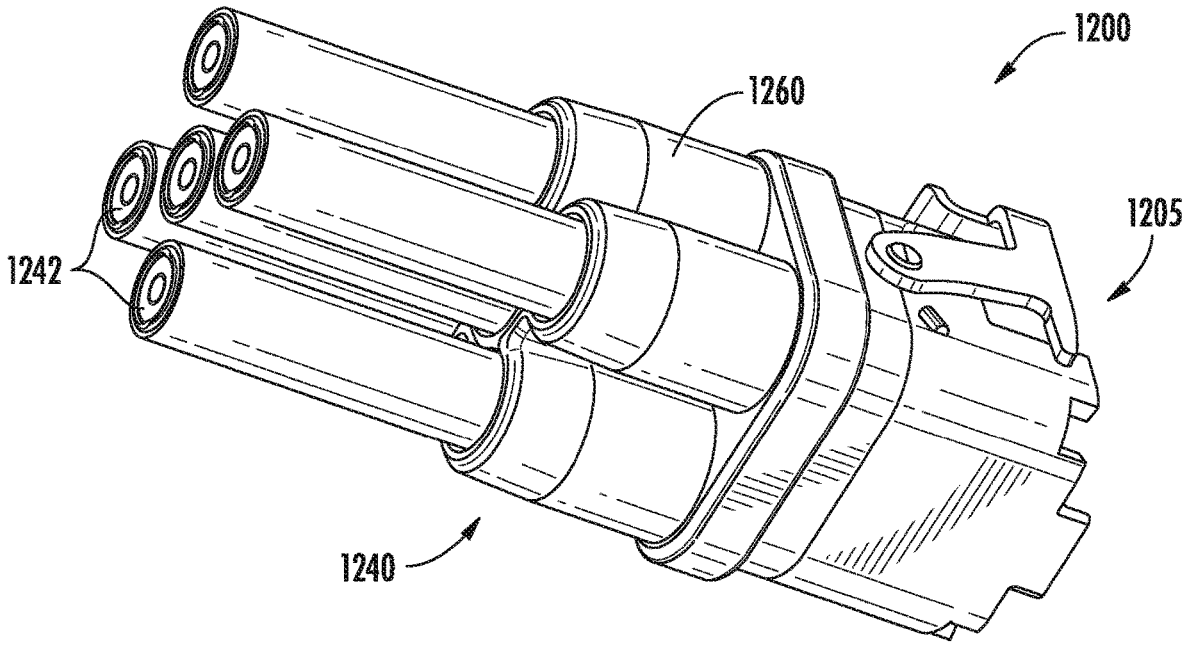
FIG. 1 is a perspective view of a prior assembly of mated ganged connectors.
Figure 2:
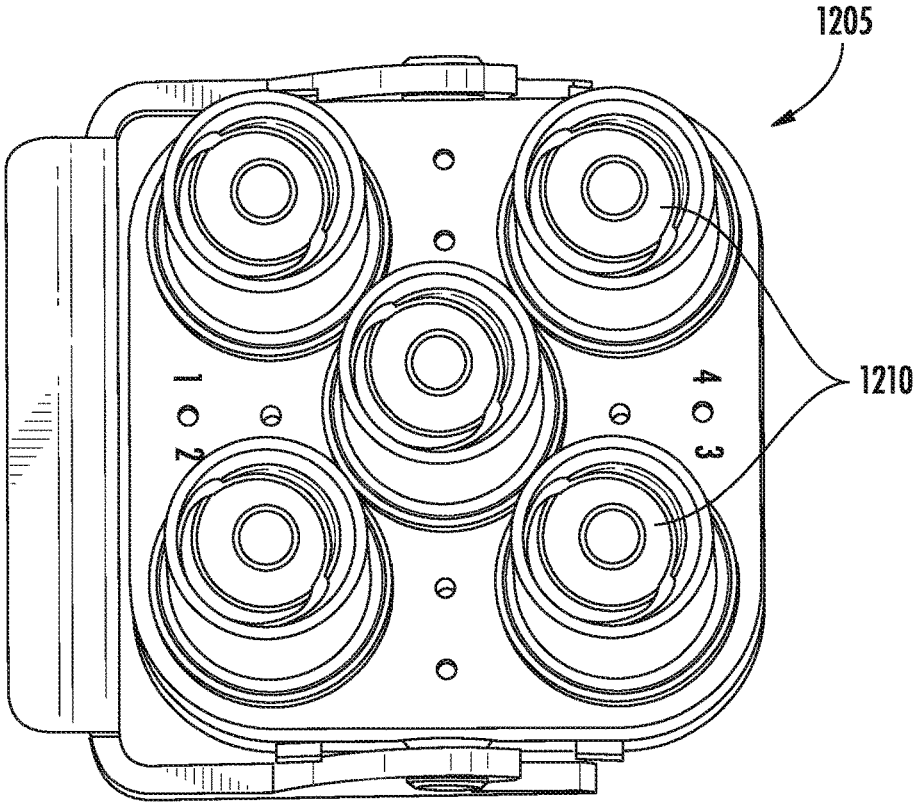
FIG. 2 is an end perspective view of the assembly of FIG. 1.
Figure 3:
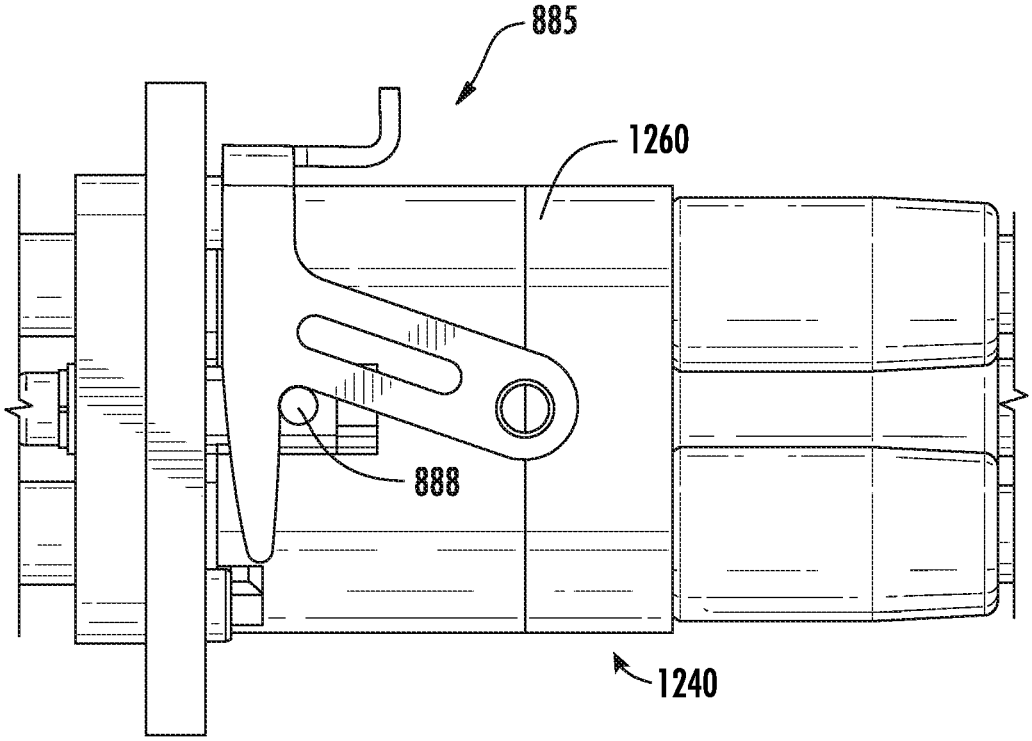
FIG. 3 is a side view of the assembly of FIG. 1 mated with a mating assembly and the latch engaged to secure the assemblies together.
Figure 4:
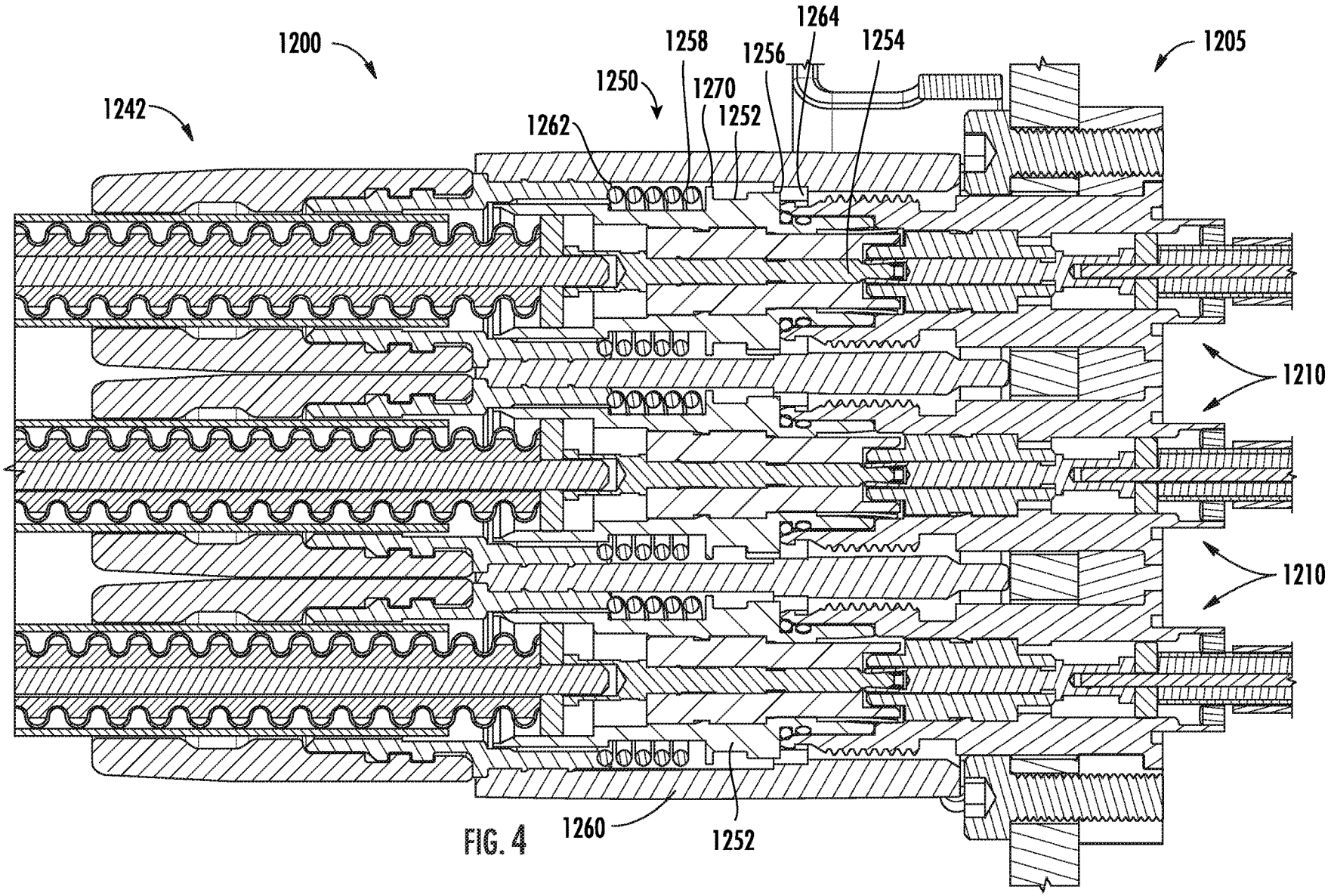
FIG. 4 is a section view of the assembly of FIG. 1 showing the springs employed to provide the individual connectors the ability to "float" relative to the housing.

An example of an assembly with provisions for axial, radial and angular is shown in FIGS. 1-4. The paired assembly of connectors 1200 shown therein includes an equipment connector assembly 1205 with five connectors 1210 and a cable connector assembly 1240 with five connectors 1250 connected to five cables 1242. As shown in FIGS. 1-2 and 4, the connectors 1210 and 1250 are arranged in a cruciform pattern, with one of the connectors 1210, 1250 surrounded by four other connectors 1210, 1250 separated from each other by 90 degrees. As shown in FIG. 3, the assemblies 1205, 1240 can be secured with a latch 885 that is pivotally mounted to the assembly 1205 and engages a pin 888 on the assembly 1240.

Referring now to FIG. 4, it can be seen that the connectors 1250 of the cable-connector assembly 1240 reside in a shell 1260. Each of the connectors 1250 includes an outer connector body 1252 and an inner contact 1254 that mate with, respectively, an outer connector body 1212 and an inner contact 1214 of a mating connector 1210 of the equipment connector assembly 1205. FIG. 4 also illustrates that each outer connector body 1252 is encircled by a helical spring 1258 that extends between a shoulder 1262 in the shell 1260 and a flange 1270 on the outer connector body 1252. The spring 1258 remains in compression. A shoulder 1256 of the outer connector body 1252 is positioned to engage a second shoulder 1264 of the shell 1260 and provide a forward limit on the forward movement of the outer connector body 1252. There is also space radially outward of the outer connector body 1252 between it and the shell 1260. Thus, the connector 1250 has the ability to float axially, radially, and angularly relative to the shell 1260, which can enable each of the connectors 1250 to adjust its position individually as needed to mate with the connectors 1210 of assembly 1205. The compressed spring 1258 provides sufficient force on the shell 1260 and the connector 1250 to maintain the connector 1250 in position relative to the shell 1260 once the connector 1250 has adjusted its position during mating.

Figure 5:
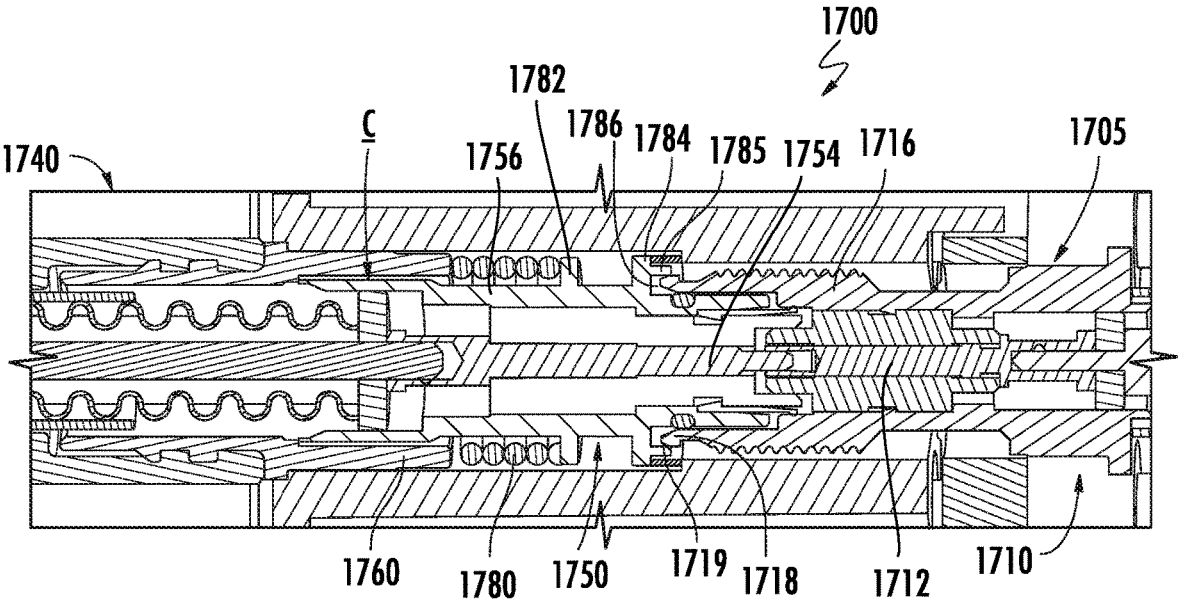
FIG. 5 is a section view of an alternative version of the assembly of FIG. 1 showing springs that provide the ability of the connectors to float.

FIG. 5 illustrates another embodiment of a ganged connector assembly 1700. The assembly 1700 is similar to the assembly 1200, with an equipment connector assembly 1705 having connectors 1710 mating with a cable connector assembly 1740 with connectors 1750 in a shell 1760. Springs 1780 provide the capacity for axial and radial adjustment of the outer connector body 1756 relative to the shell 1760 as discussed above. In this embodiment, the outer connector body 1756 has a radially-outward flange 1784 located forwardly of the flange 1782. (which captures the forward end of the spring 1780). The flange 1784 has a trepan groove 1786 in its forward surface (a projection 1785 is located radially outward of the groove 1785). Also, at the rear end of the outer connector body 1756, there is greater clearance gap C between the outer connector body 1756 and the shell 1760 than in the assembly 1200 shown in FIGS. 1-4. The outer connector body 1716 of the connector 1710 has a beveled outer edge 1719 at its forward end 1718.

As shown in FIG. 5, during initial mating of the connectors 1710, 1750, the inner contact 1754 of the connector 1750 engages the inner contact 1712 of the connector 1710, which provides a first "centering" action of the connector 1750. This action also causes the spring 1780 to "bottom out." As mating continues, the spring 1780 opens slightly, which causes the beveled outer edge 1719 of the outer connector body 1716 to contact the projection 1785. This interaction provides a second "centering" action to mating, which enables the clearance gap C between the rear portion of the outer connector body 1756 and the shell 1760 to be greater than in other embodiments.

Additional embodiments are disclosed and described in U.S Patent Publication No. 2019/0312394 to Paynter, supra.

Figure 6:
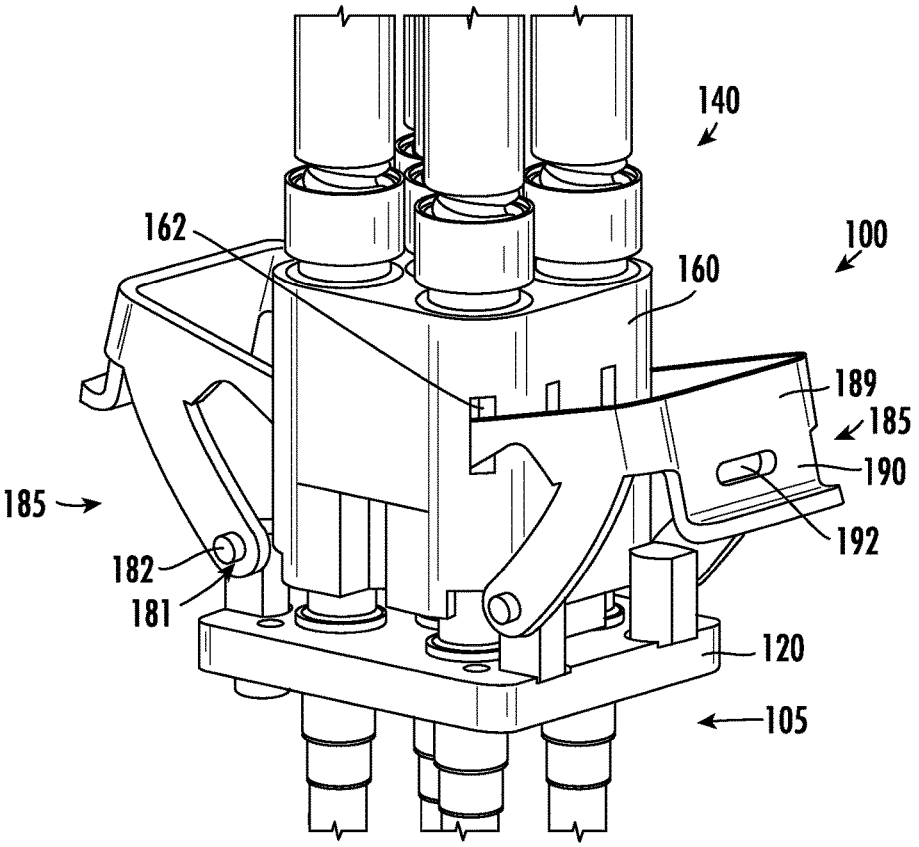
FIG. 6 is a side perspective view of ganged connector assembly according to embodiments of the invention.
Figure 7:
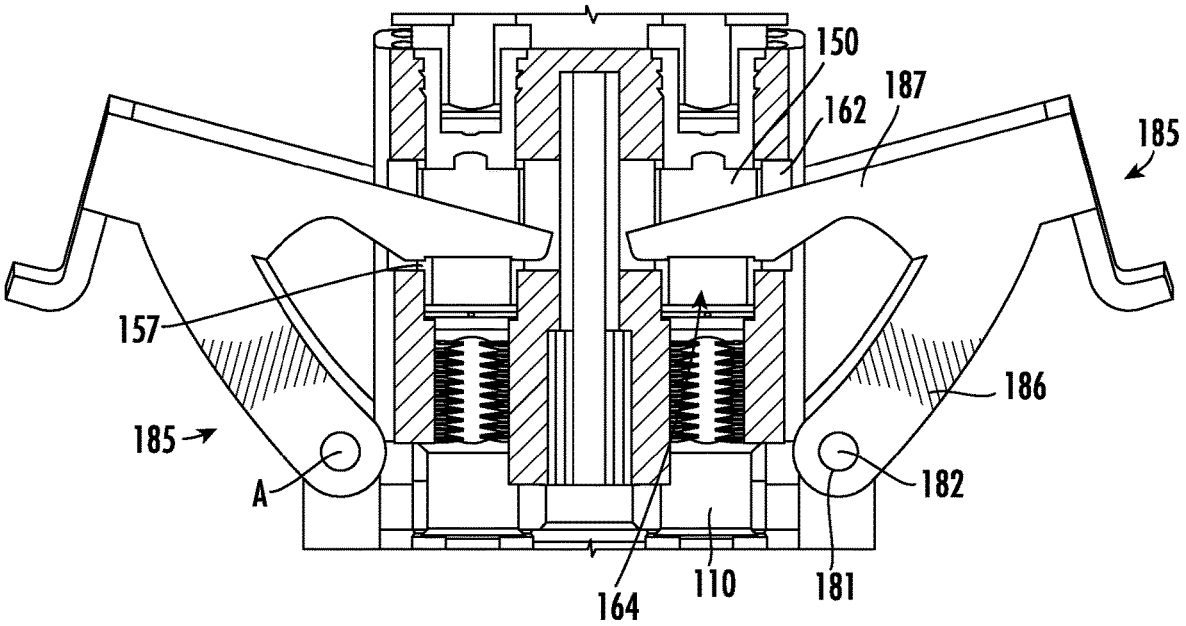
FIG. 7 is a side view of the assembly of FIG. 6, with the housing removed and the latches engaged with the connectors.

Referring now to FIGS. 6-12, another assembly of mated ganged connectors, designated broadly at 100, is shown therein. As shown in FIGS. 6 and 7, the assembly 100 includes an equipment connector assembly 105 that is similar to the assemblies 1205, 1705 discussed above, and a cable-connector assembly 140 that is similar to the assemblies 1240, 1740 discussed above. However, rather than employing springs 1258, 1780 to assist with providing float capability to the connectors 150 of the cable-connector assembly 140, and a separate latch to secure the assemblies 105, 140 in a mated condition, the assembly 100 relies on two latches 185 to both secure the assemblies 105, 140 and to assist with float capability. The mechanism by which the latch functions is discussed below.

Figure 8:
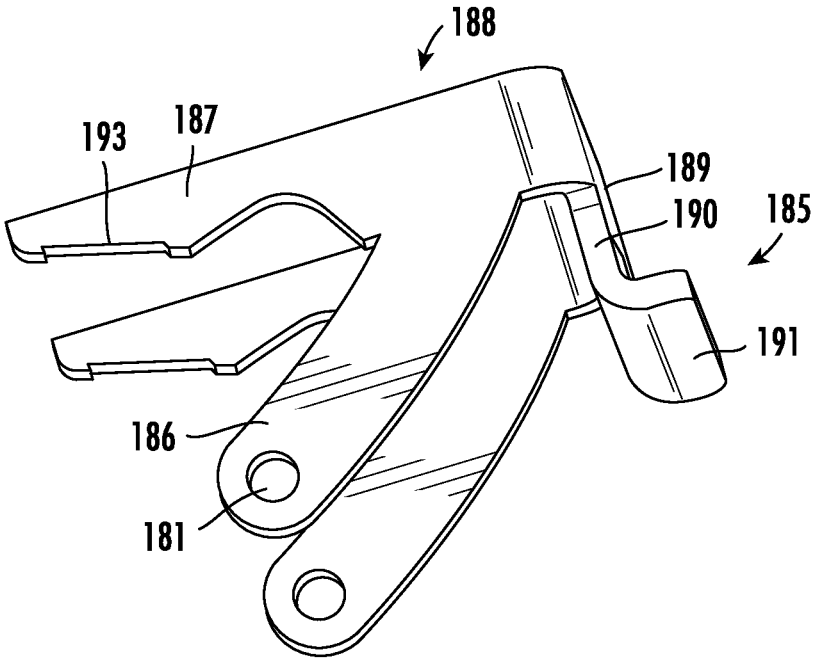
FIG. 8 is a perspective view of the latch of the assembly of FIG. 6.
Figure 9:
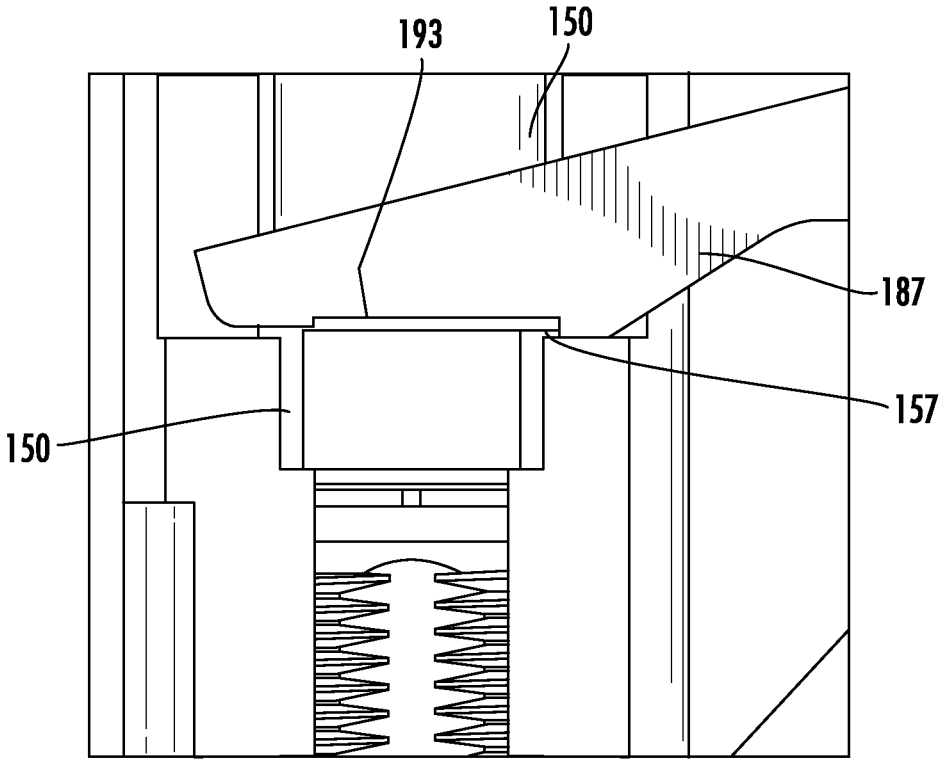
FIG. 9 is a greatly enlarged partial side view of one of the latches of FIG. 6 prior to engagement with a connector.
Figure 10:
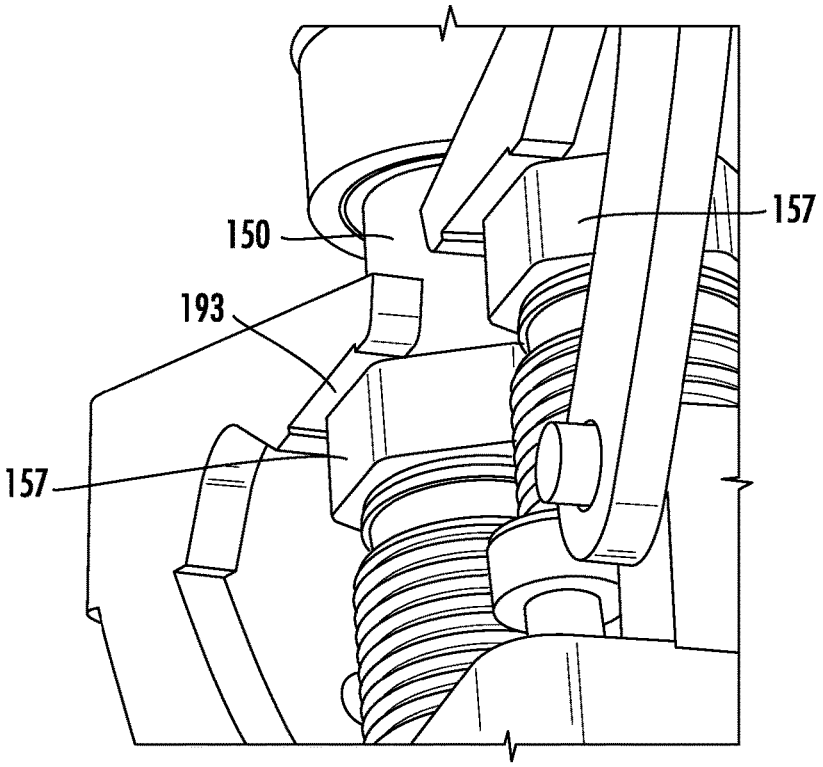
FIG. 10 is a partial side perspective view of the latches of the assembly of FIG. 6 in an engaged condition.
Figure 11:
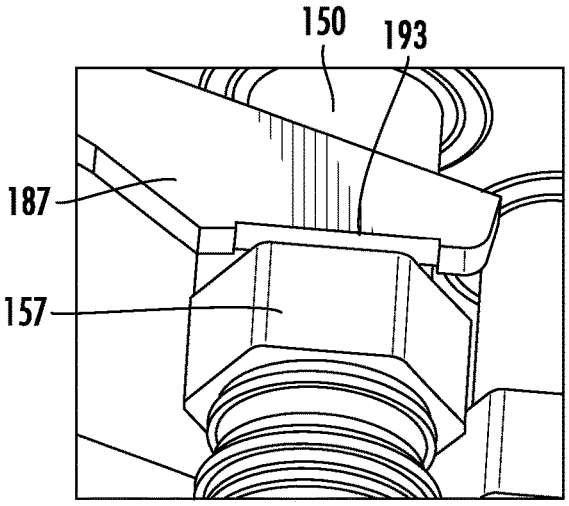
FIG. 11 is a greatly enlarged partial side perspective view of one of the latches of the assembly of FIG. 6 in an engaged condition.
Figure 12:
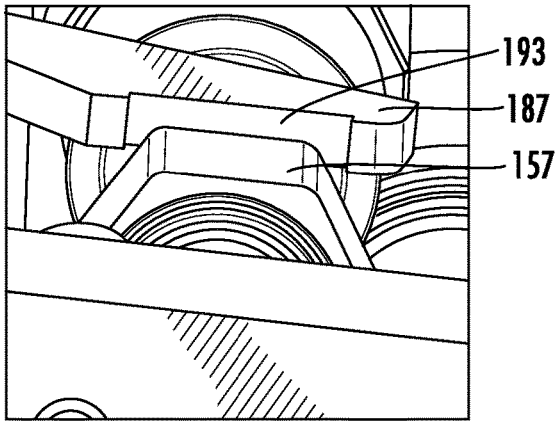
FIG. 12 is a greatly enlarged partial end perspective view of one of the latches of the assembly of FIG. 6 in an engaged condition.

Referring now to FIG. 8, each of the latches 185 has two pairs of arms 186, 187. Each pair of arms 186, 187 generally forms a "V" shaped member 188. The members 188 are spanned by a cross-member 189 that extends between the vertices of the members 188. A handle 190 extends from and generally parallel to the cross-member 189. An extension 191 extends from and generally perpendicular to the handle 190. A leverage slot 192 (for accepting a screwdriver or other leverage device) is present in the handle 190. Each arm 187 includes a recess 193 in its lower end near its free end.

Referring now to FIGS. 6 and 7, each of the aims 186 has a hole 181 that receives a pin 182 fixed to the plate 120 of the assembly 105. The pin 182 and the hole 181 define a pivot axis A.

Still referring to FIGS. 6 and 7, the shell 160 of the cable-connector assembly 140 includes four slots 162, one of which is present in each corner. Each of the slots 162 extends between the exterior of the shell 160 into a respective cavity 164 in which a respective connector 150 is positioned. Specifically, the slots 162 lead to flanges 157 that extend radially outwardly from the connector body 152.

As can be envisioned by reference to FIGS. 5 and 6, the cable-connector assembly 140 can be mated with the equipment connector assembly 105 in the usual manner, with each connector 110 of the equipment connector assembly 105 mating with a respective connector 150 of the cable-connector assembly 140. Such mating is performed with the latches 185 pivoted above the pivot axes A sufficiently that they do not interfere with the incoming cable-connector assembly 140. The assemblies 105, 140 can be secured by pivoting the latches 185 about the axes A so that the arms 187 are inserted into respective slots 162. As the arms 187 continue to advance into the cavities 164, they engage the flanges 157 of the connectors 150 (see FIG. 9). Further advancement eventually causes each flange 157 to be received in a respective recess 193 (see FIGS. 10-12). Capture of the flange 157 within the recess 193 "locks" the latch 185 in place, at which point the assemblies 105, 140 are secured together.

Notably, when the aims 187 engage the flanges 157 within the recesses 193, they exert a predominantly axially-directed force on the connector body 152 toward the equipment connector assembly 105 (i.e., toward the mating connector, or in the same direction as the helical springs 1258, 1758 in the assemblies 1240, 1740). The arms 187 (and the reminder of the latches 185) have some flexibility, so they act in the same manner as the aforementioned springs: they bias the connectors 150 toward the connectors 110, but the flexibility in the latches 185 allows the connectors 150 to float axially, radially and angularly within their cavities 158 for proper mating.

The material of the latches 185 may be selected so that, in combination with the geometry of the latches 185, when the latches 185 are engaged with the flanges 157 of the connector bodies 152, they exert a predetermined axial force on the connector bodies 152. In some embodiments, the force is between 10 and 13.5 ft-lbs. Exemplary materials include spring steel.

As can be understood from the foregoing discussion and the figures, the latches 185 can serve the dual purpose of securing the assemblies 105, 140 together in a mated condition while providing a biasing force that can facilitate the capability of the connectors 150 to float axially, radially and angularly.

It is noted that, in the illustrated embodiment, the latches 185 do not engage the center connector 150. In some embodiments, the center connector 150 is employed for calibration purposes, and therefore the mating of the center connector 150 may not require the degree of float that the remaining connectors 150 require.

Figure 13:
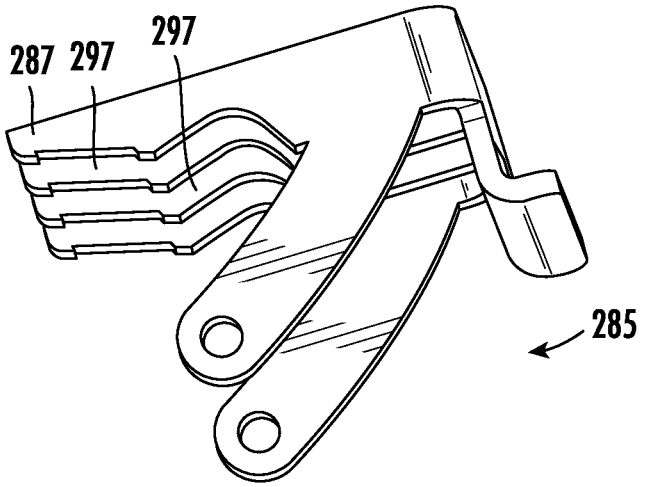
FIG. 13 is a perspective view of a latch for the assembly of FIG. 6 according to alternative embodiments of the invention.
Figure 14:
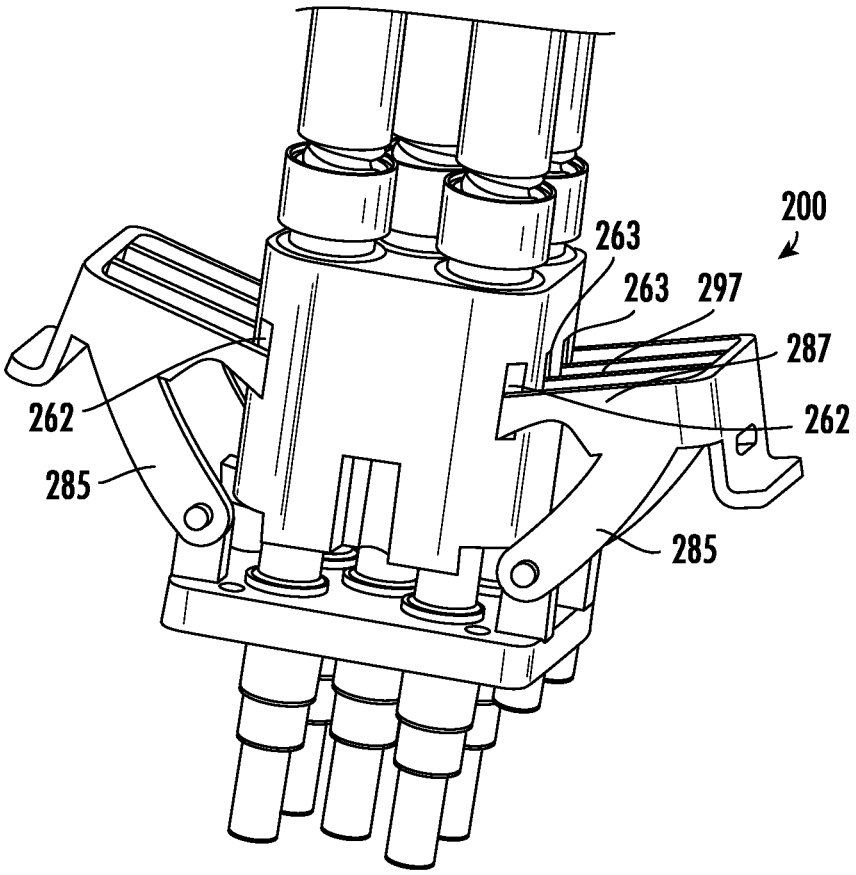
FIG. 14 is a side perspective view of mated ganged assemblies utilizing the latch of FIG. 13

Referring now to FIGS. 13 and 14, another embodiment of an assembly, designated broadly at 200, is shown therein. The assembly 200 is similar to the assembly 100 with the exception of the configuration of the latches 285. As shown in FIG. 13, each latch 285 has two additional arms 297 that are generally parallel and aligned with the aims 187. The shell 260 of the cable-connector assembly 240 has two additional slots 263 on each side, each of which receives one of the arms 297. Thus, when the latches 285 are pivoted into place, each connector 150 is contacted on one side by an arm 287 and on the opposite side by an arm 297. This configuration may enable the latches 285 to provide a biasing force to the connectors 150 in a more balanced manner.

Those of skill in this art will recognize that the assembly may take other forms. For example, the coaxial connectors may be configured differently and/or have different interfaces (e.g., DIN, 4.3/10, 2.2/5, NEX10, etc.). The connectors maybe different in number and/or arrangement. The shell is shown herein as being generally square in footprint, but may take another form (e.g., rectangular, circular, oval, etc.). Other variations are also contemplated.

Moreover, the latches 185, 285 may be configured differently in other embodiments. For example, in some embodiments only one latch may be employed, with the understanding that a single arm may engage two different coaxial connectors. In other embodiments, latches may be configured such that each coaxial connector engages a different latch (e.g., there may be four different latches for four coaxial connectors).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A mated connector assembly, comprising:

a first connector assembly, comprising a plurality of first coaxial connectors mounted on a substrate, each of the first coaxial connectors connected with a respective first coaxial cable, and further comprising a latch pivotally mounted to the substrate, the latch having an arm with a free end;

a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors;

wherein a slot is present in the shell, the slot providing access to one of the second cavities from outside the shell;

wherein in a mated condition each of the first coaxial connectors is mated with a respective second coaxial connector; and wherein the latch is pivotable between an unlatched position, in which the free end of the arm is absent from the slot, and a latched position, in which the free end of the arm of the latch extends through the slot and engages a second coaxial connector;

wherein the first and second connector assemblies are secured in the mated condition by the latch when the latch is in the latched position.

2. The mated connector assembly defined in claim 1, wherein the arm includes a recess, and wherein in the latched position the second coaxial connector is received in the recess.

3. The mated connector assembly defined in claim 2, wherein the second coaxial connector includes a radially-outwardly-extending flange, and wherein the flange is received in the recess.

4. The mated connector assembly defined in claim 1, wherein in the latched position, the arm biases the second coaxial connector toward the respective mating first coaxial connector.

5. The mated connector assembly defined in claim 1, wherein the latch is formed of a metallic material.

6. A mated connector assembly, comprising:

a first connector assembly, comprising a plurality of first coaxial connectors mounted on a substrate, each of the first coaxial connectors connected with a respective first coaxial cable, and further comprising a latch pivotally mounted to the substrate, the latch having first and second aims, each with a free end;

a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors;

wherein first and second slots are present in the Shell, each of the first and second slots providing access to a respective one of the second cavities from outside the shell;

wherein in a mated condition each of the first coaxial connectors is mated with a respective second coaxial connector; and wherein the latch is pivotable between an unlatched position, in which the free ends of the first and second arms are absent from the first and second slots, and a latched position, in which the free end of the first arm of the latch extends through the first slot and engages a first of the second coaxial connectors, and the free end of the second arm of the latch extends through the second slot and engages a second of the second coaxial connectors;

wherein the first and second connector assemblies are secured in the mated condition by the latch when the latch is in the latched position.

7. The mated connector assembly defined in claim 6, wherein the first and second arms are generally parallel.

8. The mated connector assembly defined in claim 6, wherein each of the first and second arms includes a recess, and wherein in the latched position the first and second of the second coaxial connectors are received in the recesses.

9. The mated connector assembly defined in claim 8, wherein the second coaxial connector includes a radially-outwardly-extending flange, and wherein the flange is received in the recess.

10. The mated connector assembly defined in claim 6, wherein in the latched position, the first arm biases the first of the second coaxial connectors toward the respective mating first coaxial connector.

11. The mated connector assembly defined in claim 6, wherein the shell is generally square or rectangular, and wherein the first and second slots are positioned in corners of the shell.

12. The mated connector assembly defined in claim 6, wherein the latch is formed of a metallic material.

13. A mated connector assembly, comprising:

a first connector assembly, comprising a plurality of first coaxial connectors mounted on a substrate, each of the first coaxial connectors connected with a respective first coaxial cable, and further comprising first and second latches pivotally mounted to the substrate, each of the first and second latches having first and second arms, each with a free end;

a second connector assembly, comprising a plurality of second coaxial connectors and a shell, each of the second coaxial connectors connected with a respective second coaxial cable, the shell defining a plurality of electrically isolated second cavities, each of the second coaxial connectors being located in a respective second cavity and mounted therein to float radially and axially relative to each of the other second coaxial connectors;

wherein first, second, third and fourth slots are present in the shell, each of the first, second, third and fourth slots providing access to a respective one of the second cavities from outside the shell;

wherein in a mated condition each of the first coaxial connectors is mated with a respective second coaxial connector; and wherein the first latch is pivotable between an unlatched position, in which the free ends of the first and second arms are absent from the first and second slots, and a latched position, in which the free end of the first arm of the latch extends through the first slot and engages a first of the second coaxial connectors, and the free end of the second arm of the latch extends through the second slot and engages a second of the second coaxial connectors;

wherein the second latch is pivotable between an unlatched position, in which the free ends of the first and second arms are absent from the third and fourth slots, and a latched position, in which the free end of the first arm of the second latch extends through the third slot and engages a third of the second coaxial connectors, and the free end of the second arm of the second latch extends through the fourth slot and engages a fourth of the second coaxial connectors;

wherein the first and second connector assemblies are secured in the mated condition by the first and second latches when the first and second latches are in the latched position.

14. The mated connector assembly defined in claim 13, wherein the first and second arms of the first and second latches are generally parallel.

15. The mated connector assembly defined in claim 13, wherein the first latch pivots about a first pivot axis, the second latch pivots about a second pivot axis, and the first and second pivot axes are parallel.

16. The mated connector assembly defined in claim 13, wherein in the latched position, the first arm biases the first of the second coaxial connectors toward the respective mating first coaxial connector.

17. The mated connector assembly defined in claim 13, wherein the shell is generally square or rectangular, and wherein the first, second, third and fourth slots are positioned in corners of the shell.

18. The mated connector assembly defined in claim 13, wherein the latch is formed of a metallic material.

* * * * *